US009284848B2

(12) United States Patent
Richter

(10) Patent No.: US 9,284,848 B2
(45) Date of Patent: Mar. 15, 2016

(54) METHOD FOR INTEGRALLY CONNECTING BLADES AND DISKS IN ORDER TO FORM A BLADE-DISK UNIT, AS WELL AS CORRESPONDINGLY PRODUCED BLADE-DISK UNIT

(75) Inventor: Karl-Hermann Richter, Markt Indersdorf (DE)

(73) Assignee: MTU AERO ENGINES GMBH, Munich (DE)

( * ) Notice: Subject to any disclaimer, the term of this patent is extended or adjusted under 35 U.S.C. 154(b) by 778 days.

(21) Appl. No.: 13/350,504

(22) Filed: Jan. 13, 2012

(65) Prior Publication Data

US 2012/0183404 A1 Jul. 19, 2012

(30) Foreign Application Priority Data

Jan. 13, 2011 (EP) ..... 11150851

(51) Int. Cl.
*F01D 5/30* (2006.01)

(52) U.S. Cl.
CPC ..... *F01D 5/3061* (2013.01); *F05D 2230/233* (2013.01); *F05D 2230/234* (2013.01); *F05D 2230/236* (2013.01); *F05D 2230/237* (2013.01); *Y10T 29/4932* (2015.01)

(58) Field of Classification Search
CPC ..... F01D 5/3061; F05D 2230/232; F05D 2230/236; F05D 2230/237; F05D 2230/234; F05D 2230/233; B23K 26/28; B23K 26/30; B23K 15/0053; B23K 11/065; B23K 11/067
USPC ..... 416/204 R, 213 R, 219 R, 204 A, 234, 416/248; 29/889, 889.2, 889.21; 219/121.14, 121.64; 403/270, 271, 272
See application file for complete search history.

(56) References Cited

U.S. PATENT DOCUMENTS

| | | | | |
|---|---|---|---|---|
| 3,794,807 | A * | 2/1974 | Bailey et al. | 219/121.14 |
| 4,348,131 | A * | 9/1982 | Shimanuki et al. | 403/272 |
| 5,828,032 | A * | 10/1998 | Krzys et al. | 219/121.64 |
| 6,193,145 | B1 * | 2/2001 | Fournier et al. | 228/262.41 |
| 7,634,854 | B2 * | 12/2009 | Meier | 29/889.1 |
| 2007/0189894 | A1 * | 8/2007 | Thamboo et al. | 415/216.1 |
| 2008/0148566 | A1 * | 6/2008 | Bayer et al. | 29/889.1 |

OTHER PUBLICATIONS

Studnitzky, Duffusion Soldering for Stable High-Temperature Thin Film Bonds, Dec. 2002, JOM, 58-63.*

* cited by examiner

*Primary Examiner* — Nathaniel Wiehe
*Assistant Examiner* — Eldon Brockman
(74) *Attorney, Agent, or Firm* — Kenyon & Kenyon LLP

(57) ABSTRACT

A blade-disk unit for a turbine engine includes a disk and a plurality of blades which are integrally connected to the disk, a welding seam being disposed in the joining region between the blade and the disk, which welding seam is situated entirely either in the blade or in the disk.

14 Claims, 3 Drawing Sheets

METHOD FOR INTEGRALLY CONNECTING BLADES AND DISKS IN ORDER TO FORM A BLADE-DISK UNIT, AS WELL AS CORRESPONDINGLY PRODUCED BLADE-DISK UNIT

CROSS-REFERENCE TO RELATED APPLICATIONS

The present application claims priority to Application No. 11150851.1, filed in the European Patent Office on Jan. 13, 2011, which is expressly incorporated herein in its entirety by reference thereto.

FIELD OF THE INVENTION

The present invention relates to methods for integrally connecting blades and disks in order to form a blade-disk unit as well as to correspondingly produced blade-disk units.

For example, the present invention relates to a blade-disk unit for a turbine engine, having a disk and a plurality of blades which are integrally connected to the disk.

BACKGROUND INFORMATION

Integrally connected blade-disk units, which are also referred to as 'blisk', are used in the manufacture of turbine engines such as gas turbines or aircraft engines, blisk being shorthand for the combination of blade and disk. Such blade-disk units, which constitute a rotor for a corresponding gas turbine or an aircraft engine, are characterized by the fixation of the blades on the disk in integral fashion, e.g., by welding. However, inasmuch as different materials are used for the blades and the disks in the turbine, welding the blades directly to the disk is impossible in such a case, because the welding could cause a corresponding change in, or damage to, the disk or blade material, which would lead to an unacceptable characteristics profile.

For example, forgeable nickel alloys suitable for fusion welding such as Inconel 718, for example, are frequently used in the turbine of aircraft engines; the blade materials, on the other hand, are polycrystalline, directedly solidified or monocrystalline nickel cast alloys having a high γ' component, which imbues the blade material with the necessary strength. Fusing of the blade material would destroy this structure and therefore have a detrimental effect on the strength of the blade.

It is conventional to use an adaptor between the blade and disk, the adapter being joined to the blade by friction welding, and the adapter subsequently being fixed in place on the disk by fusion welding. However, this is very costly and labor-intensive due to the additional use of the adapter and the required additional welding operations.

SUMMARY

Example embodiments of the present invention provide a method for producing a blade-disk unit (blisk) and also a corresponding blade-disk unit, the method being less complex and more effective to implement, but simultaneously ensuring that the characteristics profile of the blisks produced in this manner is not adversely affected.

Example embodiments hereof are based on an integral connection between disk and blade being achievable if one of the joining partners, i.e., either the blade or disk, is not fused, and fusing is implemented only in the other joining partner, i.e., the blade or disk, as the case may be, the fused material in the process allowing a soldered connection to be provided in the joining region, and/or the energy introduced by the fusing being sufficient to form a diffusion connection, for example, in the joining region of the blade and disk.

A welding seam is therefore provided at a distance from the actual joining area, or directly in the joining area, but only in the area of one of the joining partners, whereas the other joining partner, i.e., either disk or blade, is not fused. In other words, a welding seam denotes that a region of one of the components to be joined is fused, so that a fused region is produced there. However, a welding seam does not necessarily mean that mixing of materials of the components to be joined arises there in terms of fusion technology. Instead, one of the components to be joined, i.e., either the blade or disk—especially the blade in aircraft engines—is not fused, but connected instead merely by fused material of the joining partner (e.g., the disk in aircraft engines), by a soldered connection or the heat provided in the melting region, via a diffusion connection.

The welding seam may be introduced at a distance of 0 to 3 mm, in particular, preferably 0 to 2.5 mm from the actual connection surface, i.e., the abutting surface of the components to be joined, either in the disk or the blade, and the welding seam itself may have a thickness of 2 to 100 mm, especially 5 to 75 mm, in a direction transversely to the butt joint.

Disk and blade may, in particular, form a butt joint having a centering lip; the welding seam may be arranged as an I-seam.

To ensure that the connection properties are identical across the entire joining area, the welding seam may especially be introduced such that a flank of the welding seam delimiting it is formed parallel to the butt joint or abutting surface. In a welding seam accordingly arranged in the form of a cone, the welding seam may therefore be introduced into the material at a slight angle, in accordance with the opening angle of the welding cone.

Methods of energy beam welding, in particular, such as electron beam welding or laser beam welding, for example, may be used as welding methods, but other suitable welding methods may be utilized as well.

Multi-beam methods are an alternative, in which one or more additional energy beam(s) is/are provided in addition to the actual energy beam that results in the fusing of an area of the edge material of a joining partner, the additional energy beams heating adjacent regions, in particular the region of the actual butt joint, so as to improve the arrangement of the integral connection, or to make such a connection easier to achieve.

In the joining area, i.e., the butt joint or the abutting surface between the disk and blade to be joined, soldering material may be introduced in addition, such as in the form of a solder film made of a metallic material, in particular nickel or a nickel alloy, which likewise fuses and provides a soldered connection when heated by the adjacent fusion area (welding seam).

DETAILED DESCRIPTION

Figure 1:
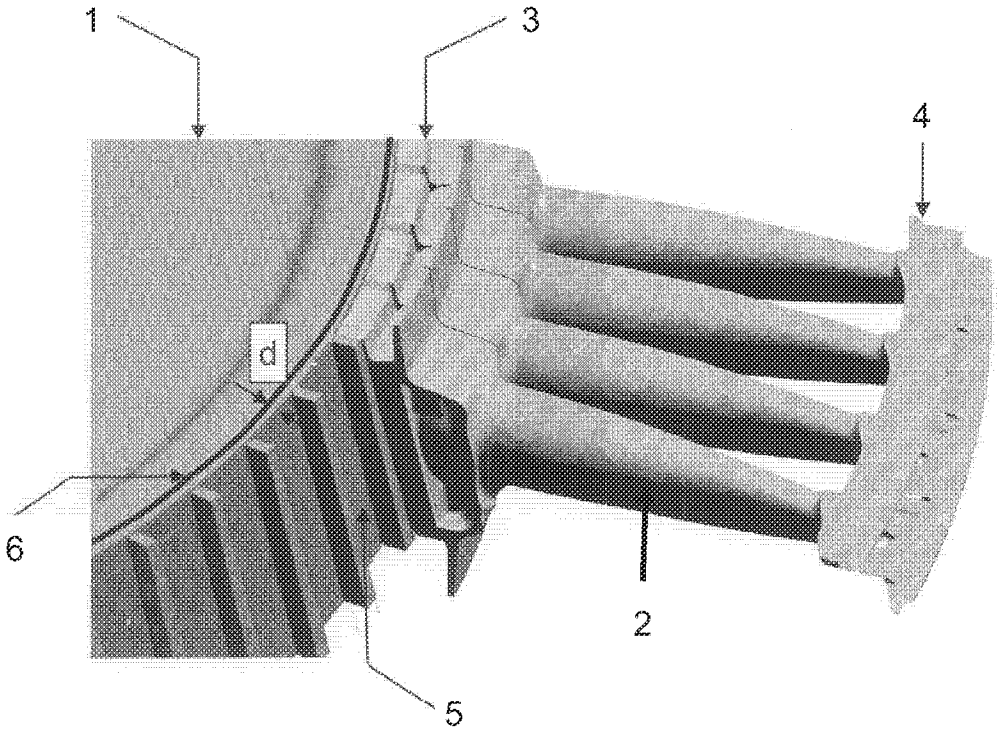
FIG. 1 is a partial perspective view of a blade-disk unit (blisk) according to an example embodiment of the present invention.

A blisk according to an example embodiment of the present invention is shown in FIG. 1 in a partial perspective view. The blisk shown in FIG. 1 includes a disk 1 on which a multitude of blades 2 is situated, or is able to be situated. On one side blades 2 have a covering band 4, and on the opposite side, a blade root 4, via which the blades are connected to disk 1.

For this purpose, a multitude of grooves 5, into which blade roots 3 of blades 2 are inserted, is provided on the cylinder sleeve surface of disk 1 along the circumference.

In addition, FIG. 1 shows where the welding seam is provided in the illustrated exemplary embodiment of FIG. 1 in order to create an integral connection between blades and disk by fusing the disk material.

As shown in FIG. 1, welding seam 6 is situated at a specific distance d from the surface of disk 2 or the abutting surface between disk 1 and blades 2. Grooves 5, which are provided to accommodate blade root 3, are formed in disk 1. The fusing of the disk material in the region of welding seam 6 also causes heating in the connection region between blade root 3 and the boundary material of disk 1 in grooves 5, so that an integral connection is formed there accordingly. If the melted disk material flows into the joining region between disk 1 and blade 2, a solder connection is formed in which fused disk material is acting as solder material for the connection to the blade root. Welding seam 6, i.e., the fused region, may reach directly up to blade root 3, provided the blade material is not fused or is not damaged in some other manner by an excessive introduction of heat.

Furthermore, the fused region, i.e., welding seam 6, may also be introduced at a distance d from the actual abutting surface at which blade root 3 and the disk rest against each other, so that only the disk material, thus heated, at the abutting surface between blade root 3 and disk 1 provides an integral connection.

Figure 2:
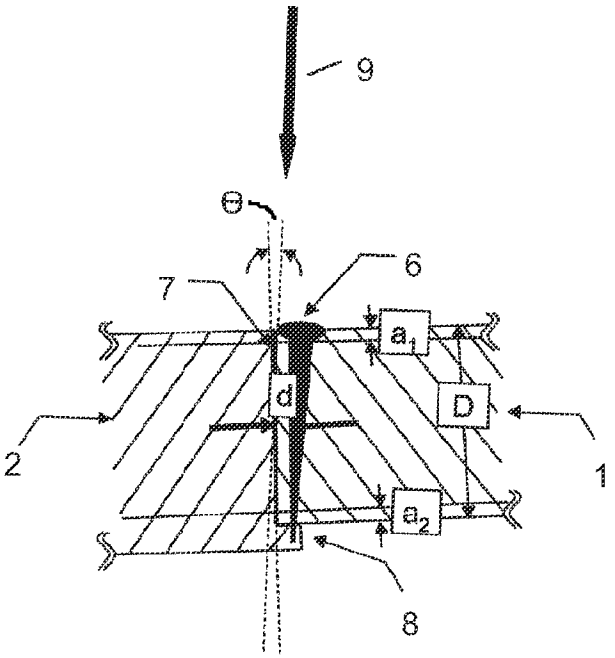
FIG. 2 is a partial cross-sectional view through a blisk according to an example embodiment of the present invention, in the joining region of disk and blade.
Figure 3:
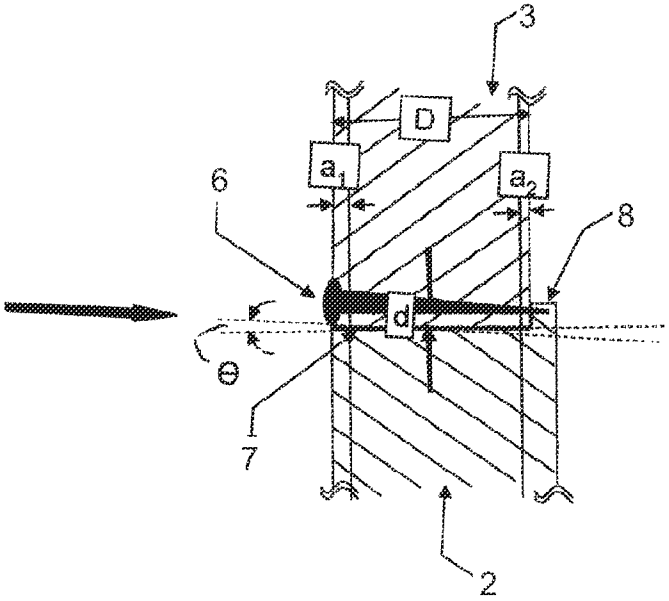
FIG. 3 is another cross-sectional view according to the illustration in FIG. 2, the welding seam being formed transversely.

The situation with regard to the position and the introduction of welding seam 6, i.e., the fused region, is shown in FIGS. 2 and 3 in cross-sectional views of the connecting region of blade 2 and disk 1, in a so-called trough position on the one hand, and in the transverse position (FIG. 3) on the other.

FIGS. 2 and 3 illustrate that the joint at which disk 1 and blade 2 are connected to each other may be arranged substantially as a butt joint, a so-called I-seam having a centering lip 8 being able to be formed at the butt joint. For this purpose, the thickness of blade 2 is selected slightly greater than thickness D of disk 1, so that the blade projects beyond disk 1 in the region of centering lip 8 and forms a contact shoulder.

As illustrated in the cross-sectional views of FIGS. 2 and 3, welding seam 6 is not introduced in the region of butt joint 7, where disk 1 and blade 2 rest against each other, but at a slight offset by distance d in the direction of the disk material. Although, depending on the material selected for disk 1 and blade 2, an introduction of welding seam 6 in the blade material is possible as well, in the exemplary embodiment shown for a turbine blisk in the construction of an aircraft engine, disk 1 is chosen for the introduction of welding seam 6, since the disk material normally is a forgeable Nickel alloy suitable for fusion welding, such as Inconel 718, while in the case of the blade material, polycrystalline, directedly solidified or monocrystalline cast alloys are employed which, due to their high γ' component, are usually unsuitable for fusion-welding, since tears would otherwise be produced and, furthermore, their strength-increasing γ' structure is destroyed.

Welding seam 6 may be introduced by suitable energy beams such as electron beams or laser beams, but other suitable welding methods may be utilized as well.

The shape of welding seam 6, i.e., the fused region, is usually conical in cross-section, that is to say, the seam has flanks which extend towards or away from each other and delimit welding seam 6. Therefore, welding seam 6 is advantageously introduced such that the flank, that is to say, the edge region of welding seam 6 that is situated adjacent to the joining region—in the case at hand, adjacent to blade 2—if possible extends parallel to the butt joint or the abutting surface formed thereby, in order to prevent that the conical arrangement creates different joining conditions over the cross-section of the integral connection, due to the different clearances between the fused region and the components to be joined. Thus, in the event that no welding seam 6 having parallel flanks is able to be produced by the welding method, electron or laser beam 9, with whose aid welding seam 6 is introduced, is tilted relative to butt joint 7 or the surface of the components to be joined, such that the flank, adjacent to butt joint 7, of welding seam 6 is formed parallel to the butt joint or the abutting surface. For example, this can easily be accomplished by tilting the components by angle θ relative to the electron or laser beam, the angle corresponding to the opening angle of the conical welding seam.

Thickness D of the disk material may be selected such that welding errors such as caused by a "nail head" in the region of the beam entry, lie within allowance $a_1$, while welding errors that occur in the region of the welding seam root lie within allowance $a_2$, so that, over all, no adverse effects on the required strength values for disk 1 have to be expected.

Distance d of welding seam 6 from butt joint 7 may have different dimensions, depending on the material combinations used for disk 1 and blade 2.

In addition, a solder material, e.g., in the form of a solder film of a metallic material such as nickel or a nickel alloy, in particular, may be disposed in the region of the butt joint, which solder material fuses and forms a corresponding solder connection when the beam energy for creating welding seam 6 is introduced.

If the disk material or an additionally introduced solder material does not fuse directly in the region of the butt joint, then the integral connection takes place by diffusion welding directly at the butt joint.

To enhance the heating especially in the region of the butt joint, additional energy beams may be employed parallel to electron or laser beam 9, which are aimed directly at the region of butt joint 7 and provide additional heating there, without leading to fusing of the material, however, and especially not to fusing of the blade material.

It should be understood that the foregoing description of example embodiments should not be considered limiting and that modifications are possible such that individual features may be omitted or other types of combinations of features are provided.

What is claimed is:

1. A blade-disk unit for a turbine engine, comprising:

a disk;

a plurality of blades integrally connected to the disk; and a weld seam provided in a joining region between the blade and the disk and provided entirely either in the blade or the disk, wherein the welding seam is located at a distance of greater than 0 to 3 mm from at least one of (a) an edge of a joined disk or blade which is closest to the welding seam and (b) an edge of the blade or the disk which is closest to the welding seam in which the welding seam is located.

2. The blade-disk unit according to claim 1, wherein at least one of (a) a soldered region and (b) a diffusion region adjoins the welding seam in a direction of an adjacent blade or disk.

3. The blade-disk unit according to claim 1, wherein the welding seam is located in the disk.

4. The blade-disk unit according to claim 1, wherein the welding seam is located at a distance of greater than 0 to 2.5 mm from at least one of (a) the edge of the joined disk or blade which is closest to the welding seam and (b) the edge of the blade or the disk which is closest to the welding seam in which the welding seam is located.

5. The blade-disk unit according to claim 1, wherein the welding seam has a thickness of at least one of (a) 2 to 100 mm and (b) 5 to 75 mm.

6. The blade-disk unit according to claim 1, wherein the blade-disk unit is arranged as a turbine blisk for an aircraft engine.

7. A blade-disk unit for a turbine engine, comprising:

a disk;

a plurality of blades integrally connected to the disk; and a weld seam provided in a joining region between the blade and the disk and provided entirely either in the blade or the disk, wherein the welding seam is arranged as an I-seam having a centering lip.

8. The blade-disk unit according to claim 1, wherein the disk and the blade form a joint at which the disk and the blade abut each other, the joint having an abutting surface, and the welding seam having flanks that delimit the welding seam, and the flank, adjacent to the abutting surface, of the welding seam is substantially parallel to the abutting surface.

9. A method for producing a blade-disk unit for a turbine engine having a disk and a plurality of blades integrally connected to the disk, comprising:

placing at least one blade on the disk;

fusing an edge region of the blade or the disk that is situated adjacent to the disk or the blade to be connected; and connecting the blade and the disk by at least one of (a) a fused material of either the blade or the disk and (b) an action of heat from a fused region, wherein one of the blade and the disk is not fused, wherein a welding seam is provided in a joining region between the blade and the disk and provided entirely either in the blade or the disk, wherein the welding seam is located at a distance of greater than 0 to 3 mm from at least one of (c) an edge of a joined disk or blade which is closest to the welding seam and (d) an edge of the blade or the disk which is closest to the welding seam in which the welding seam is located.

10. The method according to claim 9, wherein the fusing is performed by at least one of (a) an energy beam method, (b) an electron beam welding method, and (c) a laser beam welding method.

11. The method according to claim 9, further comprising heating at least one of (a) adjacent regions and (b) a joint region by a multi-beam method using at least one energy beam in addition to an energy beam for the fusion.

12. The method according to claim 9, further comprising introducing a solder material into a joint region between the disk and blade.

13. The method according to claim 12, wherein the introducing includes placing the solder material between the disk and blade in the form of a film.

14. A blade-disk unit for a turbine engine, comprising:

a disk;

a plurality of blades integrally connected to the disk; and a weld seam provided in a joining region between the blade and the disk and provided entirely either in the blade or the disk, wherein the welding seam is located at a distance of greater than 0 to 3 mm from at least one of (a) a joined disk or blade and (b) an edge of the blade or the disk in which the welding seam is located, wherein the welding seam is arranged as an I-seam having a centering lip.

* * * * *